United States Patent [19]

Howell

[11] Patent Number: 5,050,339

[45] Date of Patent: Sep. 24, 1991

[54] CONTAINER PLANT STAND

[76] Inventor: Randolph W. Howell, 4595 125th Ave. S., Lake Worth, Fla. 33467

[21] Appl. No.: 322,342

[22] Filed: Mar. 13, 1989

[51] Int. Cl.[5] ..... A47G 7/00

[52] U.S. Cl. ..... 47/39; 248/113; 248/114; 248/115

[58] Field of Search ..... 47/39, 70, 45; 248/113, 248/114, 115, 27.8

[56] References Cited

U.S. PATENT DOCUMENTS

| | | | |
|---|---|---|---|
| 353,131 | 11/1886 | Greenwood | 47/39 |
| 711,970 | 10/1902 | Hooper | 248/313 |
| 4,757,641 | 7/1988 | Penrod | 47/39 |

FOREIGN PATENT DOCUMENTS

| | | | |
|---|---|---|---|
| 241642 | 11/1929 | Fed. Rep. of Germany | 47/39 |
| 1257504 | 2/1961 | France | 47/39 |
| 1327100 | 4/1963 | France | 47/39 |
| 12622 | of 1897 | United Kingdom | 47/39 |
| 25194 | of 1898 | United Kingdom | 47/39 |
| 24088 | of 1912 | United Kingdom | 47/39 |

*Primary Examiner*—Henry E. Raduazo

[57] ABSTRACT

A plant stand for container grown nursery plants which holds container plants upright especially during times of wind, comprises a large circular ring and a smaller circular ring and a plurality of upside-down "U" shaped vertical braces secured to the inside of the large circular ring and secured to the inside and projecting above the smaller circular ring to form an adjustable diameter tension opening to hold upright a container grown plant.

5 Claims, 1 Drawing Sheet

CONTAINER PLANT STAND

BACKGROUND OF THE INVENTION

It is a common practice in the wholesale and retail plant nursery industry to grow plants in reusable pots or containers, such containers ranging in size from a fraction of an inch to five feet or more in diameter, stepping up the plants from smaller to larger containers as the plants grow . . . . These plant containers are designed, with the top larger in diameter than the base, to allow the removal of the plant and its attached root system intact. From the design, therefore, the plant container is larger and heavier at the top than the bottom, making the container top heavy. In addition, as the plant grows larger in the container, its mass often becomes a surface area large enough and tall enough to add to an already existing problem of more weight and mass at the top rather than the bottom. These two factors combined often create a top heavy plant growing in a top heavy container.

Container plants are, therefore, often pushed over by naturally occurring winds. When this occurs, the plants are damaged as they fall over, soil and fertilizer spill out of the container, the plants do not receive proper watering, and considerable time and effort are consumed to set upright the fallen over container plants.

The present inventor has observed that because of the top heavy condition of container plants and their ease with which they fall over due to winds, many container plants end up damaged or dead. Unless the container plants are held upright, these losses will continue.

SUMMARY OF THE INVENTION

The primary purpose of the present invention is to provide an inexpensive and lightweight container plant stand which prevents container plants from falling over due to wind. More specifically, the invention provides such a stand in the form of a large circular ring adapted to be set firmly on the ground surface and a smaller circular ring, and a plurality of upside-down "U" shaped vertical braces secured to the large circular ring and secured to and projecting above the smaller circular ring, the top end of each vertical ring to form an adjustable diameter tension opening to receive and hold upright a plant container or potted plant. In other words, the basic purpose of the invention is to convert a top heavy plant container into a stable based plant container resistant to wind.

Other objects and advantages of the invention will be apparent from the following description, the accompanied drawings and the appended claims.

Figure 1:
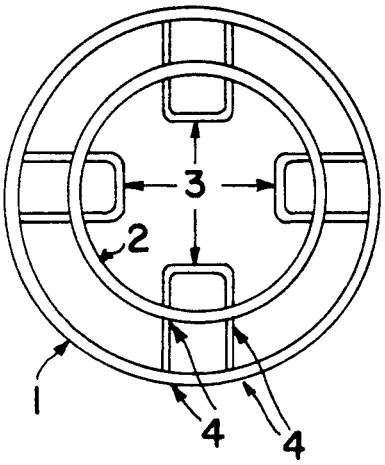
FIG. 1 is a top view of the container plant stand.

All three figures are of the complete container plant stand ready for use.

DESCRIPTION OF THE PREFERRED EMBODIMENT

Referring now to the drawings in which the various parts are indicated by numerals:

The device of the invention includes a large circular ring (1), a smaller circular ring (2), and a plurality of vertical braces (3), all of which may be of galvanized wire.

Figure 2:
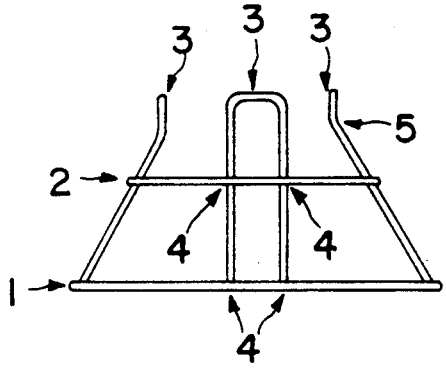
FIG. 2 is a side elevation.

Referring first to FIG. 2, the large circular ring is the base of the device which base sets on the ground surface and is proportioned larger in diameter than the smaller circular ring (2) to provide a flat stable support which prevents a plant container seated in the container plant stand from falling over due to wind. The large circular ring (1) is attached to the smaller circular ring (2) by a series of vertical braces (3), such braces connected to the large circular ring (1) and the smaller circular ring (2) at all contact points (4), preferably by welds. The vertical braces (3) preferably have a dimension twice the height of the distance separating the large circular ring (1) from the smaller circular ring (2), such braces (3) are attached on the inside of both the large circular ring (1) and the smaller circular ring (2) to provide greater resistance from the outward push of the plant container while said plant container is setting inside the device, with the smaller circular ring (2) especially supporting the vertical braces (3) from said outward push.

The vertical braces (3) are connected to the large circular ring (1) and the smaller circular ring (2) at all contact points (4) and further contact points (4) attach the vertical braces (3) on the inside of the large circualr ring (1) and the smaller circular ring (2). Such design provides a sturdy frame of support with little or no possible movement of said vertical braces (3) or large circular ring (1) or smaller circular ring (2) so that the container plant stand is strong and rigid.

By this attachment of the vertical braces (3) at all contact points (4) to the large circular ring (1) and the smaller circular ring (2), as shown in FIG. 2, the top portion (5) of the vertical braces (3) is proportioned to project above the smaller circular ring (2) for a distance equal to the length of the vertical braces (3) attached between the large circular ring (1) and the smaller circular ring (2). The top portion (5) of the vertical braces (3) is not attached to the large circular ring (1) nor attached to the smaller vertical ring (2) nor attached to any other top portion (5) of the vertical braces (3), thus allowing an adjustable diameter of the opening whereby the opening, created by the top portion (5) of the vertical braces (3), shown in FIG. 1, is circular and can be enlarged or decreased in diameter easily to facilitate the insertion or removal of the plant containers, even with slight height and/or width variances of said plant containers.

The top portion (5) of the vertical braces (3) constitutes the rebent portion (5) forming a pot receiving neck in said plant stand, bent outward from the center of the opening at such an angle so as to provide two benefits. First, the rebent portion (5) defines a straight surface parallel to the side of the plant container to grip firmly said plant container and prevent tipping of the container. Second, the rebent portion (5) allows the bottom of the plant container to slip into the stand without snagging on the top portion (5) of the vertical braces (3), but not tipped outward too much so as to prevent the stacking of the plant stands one on top of the other.

In addition, the shape of the large circular ring (1) further enhances the staying upright of the plant stand against wind by the round circle of the said ring, which, when pushed by the wind and, if tipped slightly, will present no straight edge to the ground surface to allow further tipping over of the plant stand. The plant stand will, instead of tipping further over due to wind, rock slightly back and forth on the large circular ring (1) and then set flat on the ground surface, as illustrated in FIG. 1.

Figure 3:
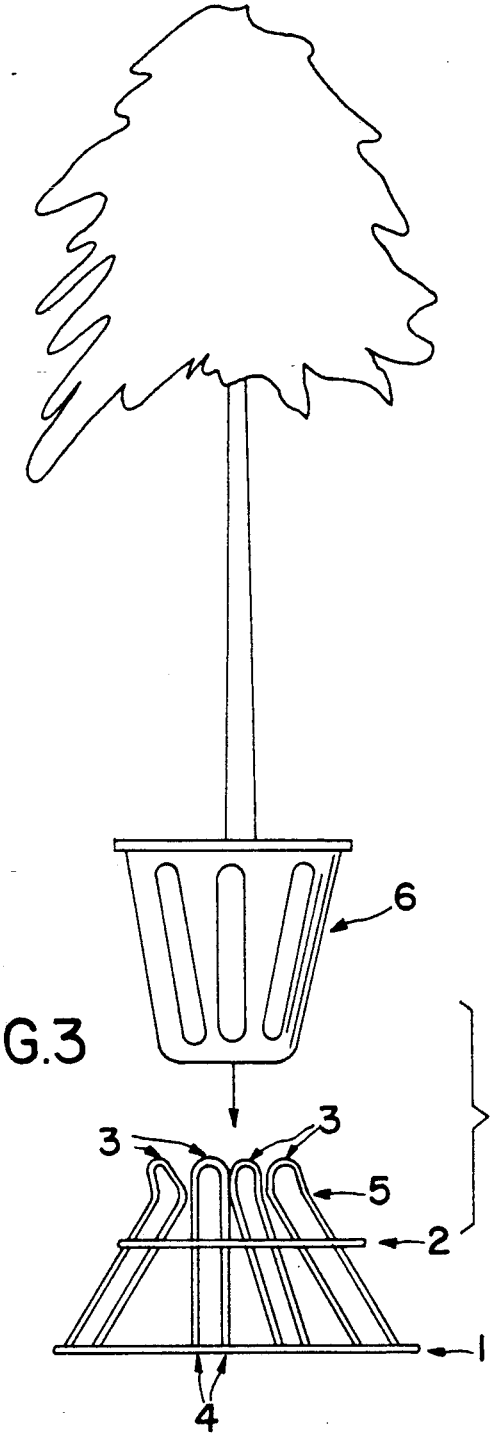
FIG. 3 is a side elevation with slight rotation.

In setting up the container plant stand for use, the stand is set on level ground, a plant in a container is set into the top opening, as shown in FIG. 3, and inserted into the stand until the container is gripped firmly by the stand and the container is setting firmly on the ground. To remove a container from the stand, it may be necessary to hold the large circular ring (1) as the container is lifted upward and out of the grip of the stand. The stand, due to its larger diameter than the container, will provide a spacing between the plant containers, whereby the stand may be set side by side touching the other stands, however, preventing the actual plant containers from touching each other.

What is claimed is:

1. A container plant stand having a wide base and a smaller neck portion for receiving a plant container comprising: first, a large ring, second, a vertically spaced smaller ring, and a series of connecting wires, each wire having two legs and a connecting U-shaped portion. . . each leg having a first portion extending from a point of intersection with said larger ring upward to a point of intersection with said smaller ring, a second portion which extends beyond said smaller ring to said neck portion, and a rebent portion extending radially away from said neck portion to a U-portion joined to said other leg whereby a plant container may be placed in and resiliently gripped by said neck portion of said plant stand and held from tipping over by means of said wide base.

2. A plant stand in accordance with claim 1 wherein said rings and said connecting wires are made from pieces of galvanized wire which are welded at the said points of intersection.

3. A plant stand in accordance with claim 1 wherein the pieces of wire forming said rings have an inside surface and an outside surface and the pieces of wire forming the U-shaped legs intersect the inside surface of said rings.

4. A plant stand in accordance with claim 1 wherein the plant stands are stackable.

5. A plant stand in accordance with claim 1, wherein said rebent portion of said neck portion form an adjustable diameter tension opening.

* * * * *